US005722570A

United States Patent [19]

Sultzer, III et al.

[11] Patent Number: 5,722,570

[45] Date of Patent: Mar. 3, 1998

[54] CONTAINER WITH EXTENDABLE, DIRECTABLE POURING SPOUT

[76] Inventors: Harry D. Sultzer, III; David Clifford Pollard, both of 432 E. Idaho, Suite C-214, Kalisbell, Mont. 59901

[21] Appl. No.: 665,083

[22] Filed: Jun. 14, 1996

[51] Int. Cl.[6] ..... B65D 47/06

[52] U.S. Cl. ..... 222/529; 222/530

[58] Field of Search ..... 222/527, 529, 222/530; 239/33

[56] References Cited

U.S. PATENT DOCUMENTS

| | | | |
|---|---|---|---|
| 2,774,523 | 12/1956 | Rieke | 222/525 |
| 3,387,232 | 6/1968 | Jellies | 215/100 |
| 3,409,224 | 11/1968 | Harp et al. | 239/33 |
| 3,776,434 | 12/1973 | Christensen et al. | 222/525 |
| 4,313,553 | 2/1982 | Lisiecki | 229/17 G |
| 4,492,324 | 1/1985 | Weber | 222/529 |
| 4,602,728 | 7/1986 | Ha | 222/530 X |
| 4,832,238 | 5/1989 | Taylor | 222/529 |
| 4,856,664 | 8/1989 | Gillispie et al. | 222/529 X |
| 4,921,147 | 5/1990 | Poirier | 222/527 |
| 5,088,632 | 2/1992 | Odet et al. | 222/530 X |
| 5,133,481 | 7/1992 | Mayfield | 222/529 X |
| 5,199,635 | 4/1993 | Abrams et al. | 229/125.09 |
| 5,350,091 | 9/1994 | Leete et al. | 222/529 |

OTHER PUBLICATIONS

Photographs of container and spout named Itasca TC–W3 Synthetic Outboard Motor Oil, manufactured by Specialty oil Co. 2740 valley View Drive, Shreveport, LA 71148.

*Primary Examiner*—Kevin P. Shaver
*Attorney, Agent, or Firm*—David L. Volk; John D. Gugliotta

[57] ABSTRACT

An extendible, retractable pouring spout is provided affixed to the upper portion of an enclosed container. The spout has a discharge orifice at its distal end and a discharge orifice sealing means, such as a cap. The pouring spout can be extended or retracted in an accordion type manner, in order to provide a directable, adjustable, funnel-like fluid discharge means from the container which can be directed into various directions and utilized in various orientations. The user is able to directionally pour the contents of the container with all the advantages of utilizing a funnel, without the necessity of utilizing an additional funnel.

1 Claim, 3 Drawing Sheets

CONTAINER WITH EXTENDABLE, DIRECTABLE POURING SPOUT

RELATED APPLICATIONS AND DISCLOSURE DOCUMENTS

This application is a continuation of the invention described in the Disclosure Document No. 384,996, dated Nov. 16, 1995.

BACKGROUND OF THE INVENTION

1. Field of the Invention

The present invention relates generally to a pour spout and, more particularly, to a container with an extendable, directable pouring spout.

2. Description of the Related Art

In the related art, there have been several attempts known for containers with pouring spouts. For example, in U.S. Pat. No. 5,199,635, issued in the name of Abrams et al., a container having a reclosable pour spout mounted thereon is disclosed. And, in U.S. Pat. No. 4,313,553, issued in the name of Lisiecki, a container with an extensible pouring spout is disclosed. Also, in U.S. Pat. No. 3,776,434, issued in the name of Christensen et al., a can with an extensible pouring spout with seal plug is disclosed. Finally, in U.S. Pat. No. 2,774,523, issued in the name of Rieke, a pull spout closure for containers is disclosed.

Although these numerous attempts have been made at modifications and improvements for containers with pour spouts, none of these attempts incorporate an expandable neck pouring spout which is directable in order to prevent spillage, waste, and splashing for all types of liquids. Consequently, a need has been felt for providing an apparatus which provides these and other benefits in a compact manner.

SUMMARY OF THE INVENTION

It is therefore an object of the present invention to provide an improved pouring spout for a container.

It is therefore another object of the present invention to provide an improved pouring spout for a container which is extendable.

It is a feature of the present invention to provide an improved pouring spout for a container which is extendable and directable in order to adapt to any particular pouring position or orientation.

Briefly described according the preferred embodiment of the present invention, an extendable, directable pouring spout is provided in affixed to a modified bottle which eliminates spills when pouring liquids such as automotive oil, or small grain solids such as sand, grains or cereals. This product resembles traditional bottles except for the accordion-like appearance of the neck portion of the product, which expands and contracts to allow liquids to be directed from the spout into the bottle. Capable of being manufactured from various types of plastic materials, key components include a neck, spout and a bottle.

An advantage of the present invention is that the expandable and directable neck prevents spillage and waste, eliminating the need for an additional funnel.

Another advantage of the present invention is that the expandable neck is collapsible, thereby becoming compact for storage purposes.

Further, a preferred embodiment of the present invention is easy and safe to use for all types of non-pressurized liquids.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
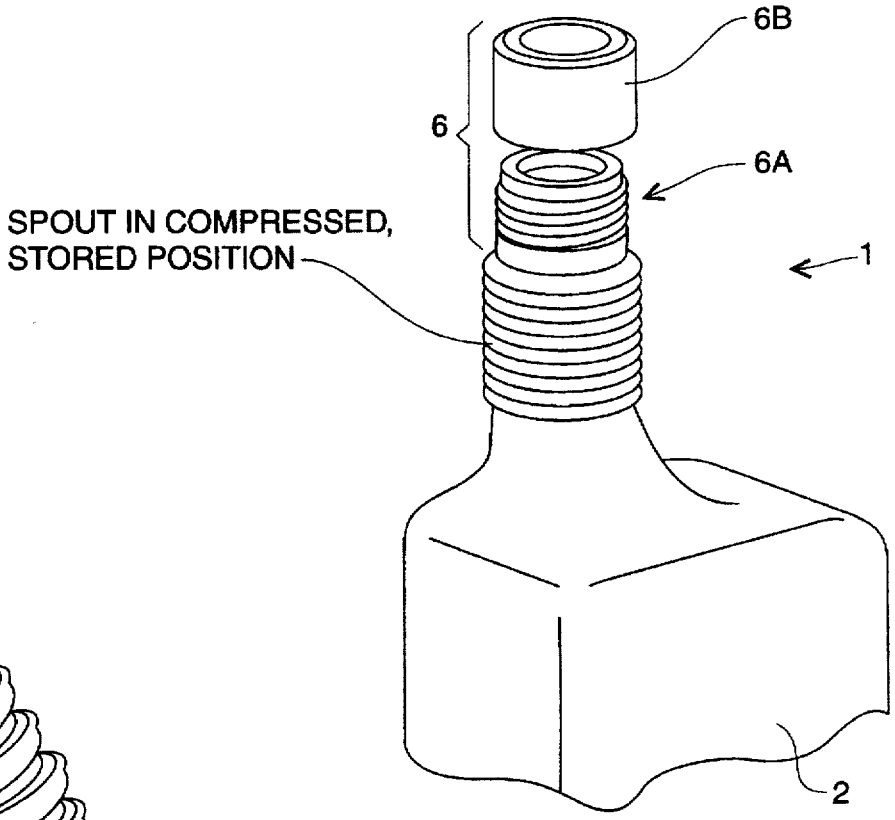
FIG. 1 is a perspective view of the preferred embodiment of the present invention with the spout in a compressed, stored configuration.
Figure 2:
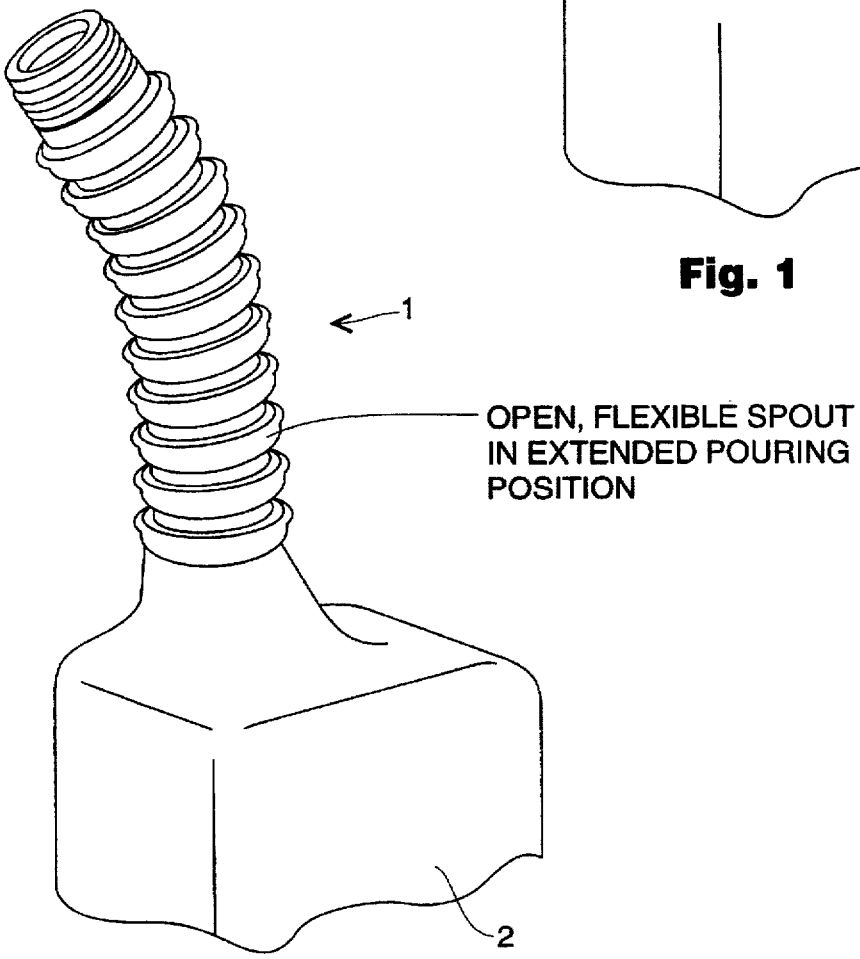
FIG. 2 is a perspective view thereof with the spout in an extended, pouring position.

Referring now to FIG. 1 and FIG. 2, an extendible, retractable pouring spout 1 is shown, according to the present invention, affixed to the upper portion of an enclosed container 2. The particular configuration of the container 2 is not considered an important limitation of the present invention in that it is envisioned that many conventional container types can be utilized in conjunction with the pouring spout 1 taught by the present disclosure. It is presently envisioned, however, the at the present invention would provide particular advantage in the dispensing of motor oil, antifreeze, liquid detergent, and the like, wherein a user is generally required to dispense a potentially messy fluid in either a space restricted manner that would otherwise be best accomplished in combination with a funnel. The spout 1 has a discharge orifice 4 at the distal end of the spout 1. A discharge orifice sealing means 6, herein disclosed as a male threaded segment 6*a* of the spout 1 in combination with a female threaded cap 6*b*, is utilized to seal the spout 1 such that fluids can be sealed within the contain 2 for storage in a contamination free manner. As shown in FIG. 1, the pouring spout 1 in its preferred embodiment is formed in an accordion type manner, as is described in greater detail below. The spout 1 is compressed such that storage of container 2 is made easier in that a lower profile is maintained. As shown in FIG. 2, the pouring spout 1 can be extended, again in an accordion type manner, in order to provide a directable, adjustable, funnel-like fluid discharge means from the container 2 which can be directed into various directions and utilized in various orientations.

Figure 3A:
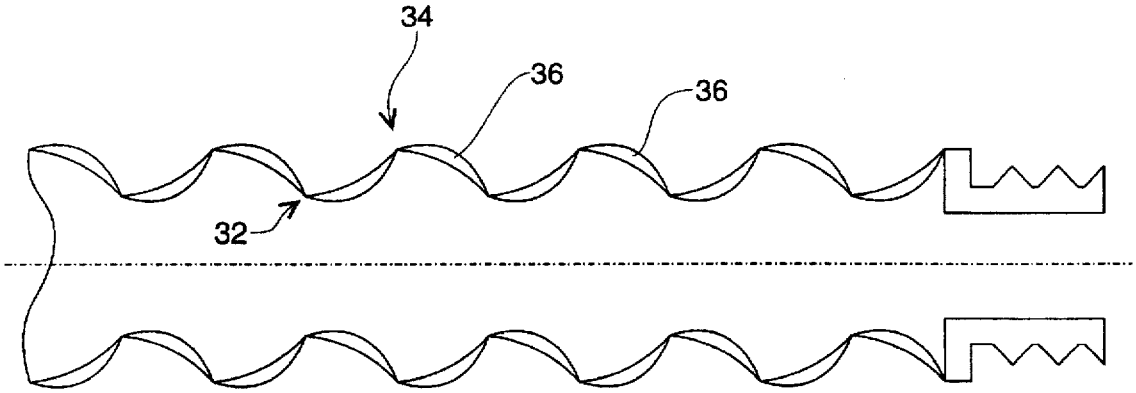
FIG. 3*a* is a cross sectional side elevational view taken along the axial centerline of the pouring spout.
Figure 3B:
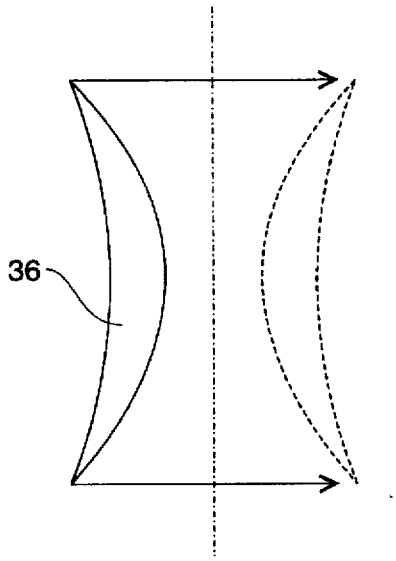
FIG. 3*b* is a detailed view taken along line III—111 in FIG. 3*a;*.

As shown in FIG. 3*a*, the details of the accordion type construction of the pouring spout 1 are more clearly indicated. The spout sidewall 30 is formed in an annular continuous manner, and has a series of inward peaks 32 alternating with outward peaks 34 in a repetitive fashion. Each inward peak 32 is an outward opening hinge between two connecting segment walls 36. Each outward peak 34 is an inward opening hinge alternately between two connecting segment walls 36. As shown in FIG. 3*b*, each segment wall 36 has a thin, arc shaped cross section. It is presently envisioned that when formed of a thin plastic material, the segment wall 36 is capable of "popping" between mirror image arc shapes upon application of shear stress across the wall segment between its opposite ends.

2. Operation of the Preferred Embodiment

Such a configuration and arrangement provides many benefits. Upon pulling of the discharge end of the spout, shear stress is transmitted linearly along the spout 1, thereby causing each segment wall to "pop" into its mirror image arc shaped configuration. With adjacent segment walls hinged together either by inward peaks or outward peaks, the respective peak will allow the hinged portion to open, thereby linearly extending the spout 1 to a length many times its compressed size. Directability of the spout 1 can be achieved by controlling the application of tension in a directional manner along the spout 1 during the spout extending process.

The user is now able to directionally pour the contents of the container 2 with all the advantages of utilizing a funnel, without the necessity of utilizing an additional funnel.

Figure 4:
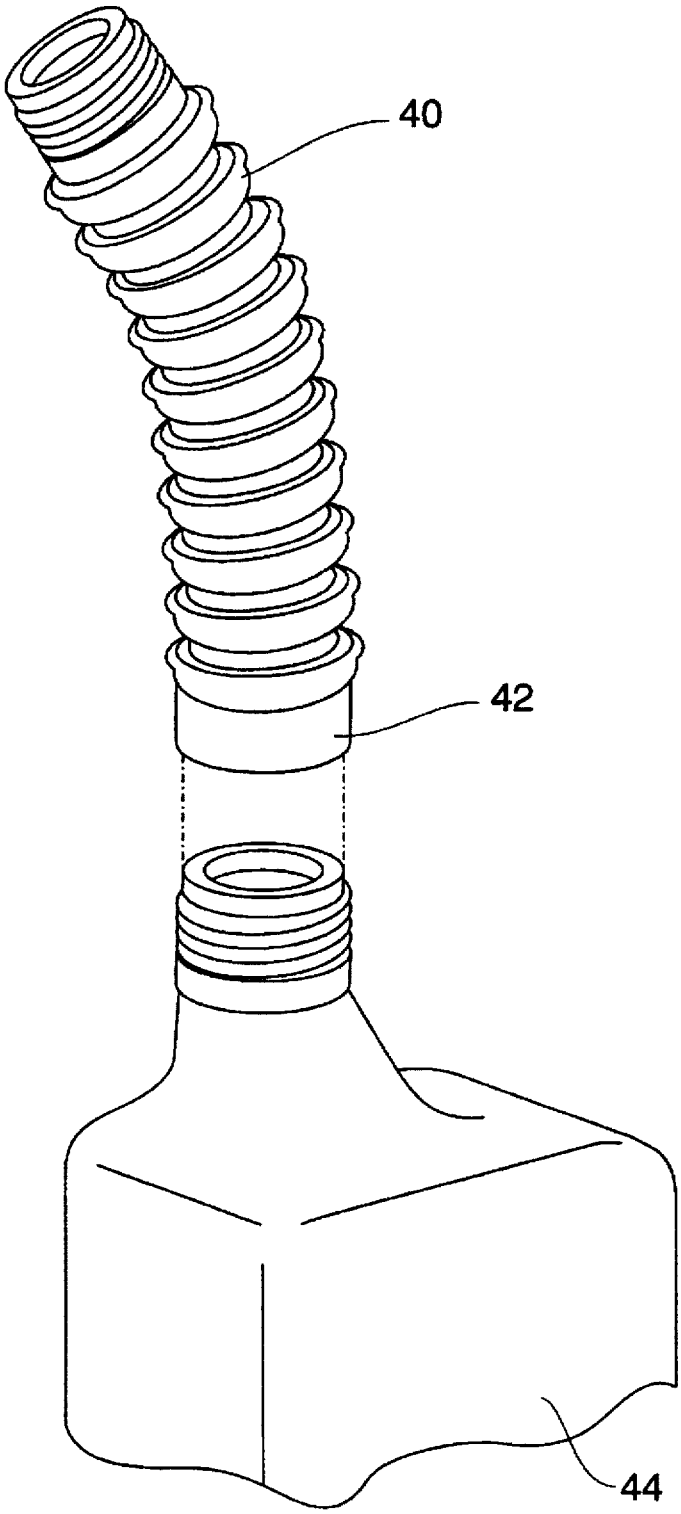
FIG. 4 is a perspective view of an alternate embodiment of the present invention depicting a spout removable from a container.

The foregoing description is included to illustrate the operation of the preferred embodiment and is not meant to limit the scope of the invention. It would be obvious to one of ordinary skill in the art that many minor variations and modifications could be attempted within the teachings of the present disclosure. For example, it is known that the present invention can be utilized in the pouring of fluids as well as many types of small grain solids. Also, as shown in FIG. 4, a detachable embodiment of a spout 40 is shown in which the spout 40 includes a threaded end 42 for threadingly engaging with many types of standard containers 44. In light of such envisioned modifications, therefore, the scope of the invention is to be limited only by the following claims.

What is claimed is:

1. An extendable, retractable pouring spout for use with a container, the spout comprising:

a. a discharge orifice at a distal end of the spout;

b. a sealing means for removably sealing the orifice;

c. a collapsible section;

d. the collapsible section comprising a spout sidewall formed in an annular continuous manner and having a series of inward peaks alternating with outward peaks;

e. each inward peak and each outward peak being a hinge between two connecting segment walls; and f. each segment wall being are shaped and configured to shift to a mirror image are shape upon application of stress thereto when the spout is extended.

* * * * *